US005967385A

United States Patent [19]

Coates, III

[11] Patent Number: 5,967,385

[45] Date of Patent: Oct. 19, 1999

[54] SPOUT BUSHING FOR FUEL DISPENSING NOZZLE

[75] Inventor: Gordon R. Coates, III, St. Charles, Mo.

[73] Assignee: Husky Corporation, Pacific, Mo.

[21] Appl. No.: 09/024,870

[22] Filed: Feb. 17, 1998

[51] Int. Cl.[6] ..... B65D 5/72; B65B 1/30

[52] U.S. Cl. ..... 222/566; 222/567; 141/206

[58] Field of Search ..... 222/566, 567; 141/206, 392

[56] References Cited

U.S. PATENT DOCUMENTS

| | | | |
|---|---|---|---|
| 2,836,333 | 5/1958 | Woodel | 222/566 |
| 3,395,740 | 8/1968 | Sutcliffe et al. | 222/566 |
| 3,474,837 | 10/1969 | Carder et al. | 222/566 |
| 3,759,423 | 9/1973 | Hansel | 222/566 |
| 5,131,571 | 7/1992 | Nolley | 222/567 |

*Primary Examiner*—Andres Kashnikow
*Assistant Examiner*—Keats Quinalty
*Attorney, Agent, or Firm*—Paul M. Denk

[57] ABSTRACT

An external bushing for the outlet end of a nozzle spout having a generally tubular body defining an inner cavity which includes a first section and a concentric second section. There is a first open end at the first section and a second open end at the second section. The second section has an end wall which slightly reduces the diameter of the second open end. The outside diameter of the first section is greater than the outside diameter of the second section. The inner diameter of the tubular body is generally constant from the first open end to the second open end and is approximately the same as the outside diameter of a dispensing nozzle spout. However there is groove formed in the inner surface of the tubular body at the approximate juncture of the first and second sections. The bushing is applied over the discharge end of a nozzle spout and attached by an internal swage operation which presses some spout material into the internal groove.

3 Claims, 2 Drawing Sheets

SPOUT BUSHING FOR FUEL DISPENSING NOZZLE

BACKGROUND OF THE INVENTION

This invention is related generally to fuel dispensing systems and, more particularly, to a spout bushing for the discharge end of a fuel dispensing nozzle. Fuel dispensing systems are well known to the art and are intended for the controlled and measured dispensing of fuels, such as gasoline or diesel fuel, from a storage vessel into an vehicle fuel tank or other container such as a gas can or similar containers. The fuel dispensing system generally comprises a pump and a dispensing nozzle. The nozzle generally includes a handle, a spout having an external spout spring around it, and internal valves, including poppet valves operatively connected to a venturi for automatically shutting off the nozzle when the fuel level in the container being filled reaches a certain level.

The spout generally is a hollow tube device having a curvilinear configuration for introduction into the container, for example, into the filler neck of the fuel tank or into a gas can. Due to the repeated use of the nozzle and multiple introductions of the spout into various containers and fuel tanks, and so forth, the tip of the spout can become damaged or bent. Such wear or damage on the tip of the spout can affect fuel flow characteristics. For example, the damaged spout can cause unwanted fuel spray. Further, the damaged spout tip can interfere with normal operation of the venturi resulting in a fuel dispensing nozzle that fails to shut-off properly. Further, it is not uncommon for the external spout spring on the fuel dispensing nozzle to slip or migrate down over the tip of the spout. If the spring moves toward the end of the spout it can interfere with the tip end or the venturi shut-off port causing the nozzle to shut of continuously.

It would be advantageous, therefore, to have an external spout bushing that can be fitted over the outlet end of the nozzle spout to retain the external spout spring in place and to prevent damage to the end of the spout.

SUMMARY OF THE INVENTION

It is, therefore, among the several objects of the present invention to provide a spout bushing that protects the outlet end of the nozzle spout.

Another object of the invention is to provide such a bushing that retains the external spout spring in place on the nozzle spout.

Yet another object of the invention is to provide such a bushing that increases the wall thickness of the discharge end of the nozzle spout.

Still another object of the invention is to provide such a bushing that is applied to the outside of the spout.

Yet another object of the invention is to provide such a bushing that can be applied by slipping over the end of the spout and is secured by swaging.

In accordance with the invention, generally stated, an external bushing for the outlet end of a nozzle spout is provided. The bushing comprises a generally tubular body defining an inner cavity which includes a first section and a concentric second section. There is a first open end at the first section and a second open end at the second section. The second section has an end wall which slightly reduces the diameter of the second open end and and is dimensioned to protect the discharge end of the spout. The outside diameter of the first section is greater than the outside diameter of the second section. The inner diameter of the tubular body is generally constant from the first open end to the second open end and is approximately the same as the outside diameter of a dispensing nozzle spout. There is a groove formed in the inner surface of the tubular body at the approximate juncture of the first and second sections. The bushing is applied over the discharge end of a nozzle spout and attached by an internal swage operation which presses some spout material into the internal groove to hold the bushing in place. The bushing is positioned and dimensioned to hold the spout spring on the exterior of the spout. The bushing generally is formed from metal, such as aluminum.

BRIEF DESCRIPTION OF THE DRAWINGS

Corresponding reference numerals indicate corresponding structures throughout the various drawings.

DESCRIPTION OF THE PREFERRED EMBODIMENT

Figure 1:
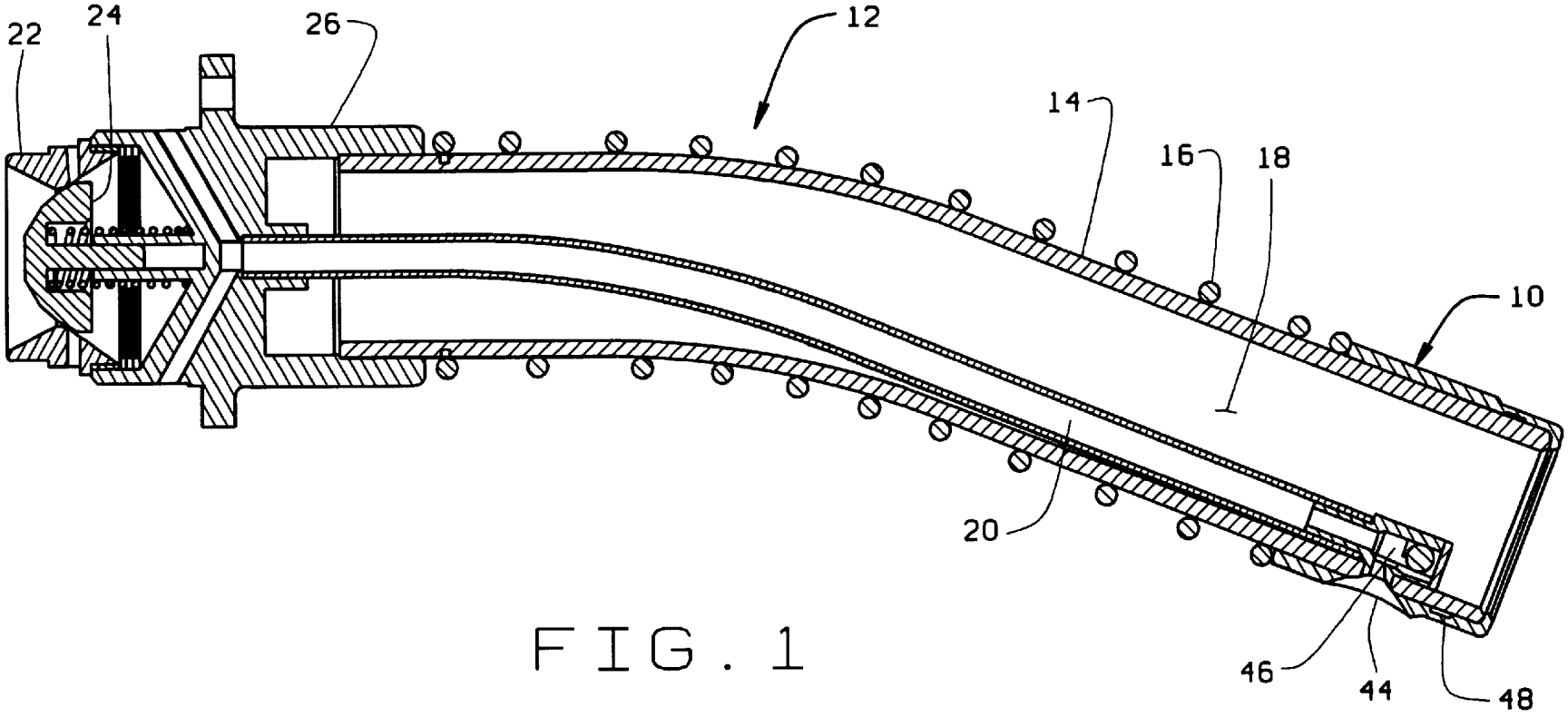
FIG. 1 is a cross sectional view of a fuel nozzle spout assembly employing a spout bushing of the instant invention.

A fuel dispensing nozzle spout bushing is indicated generally in the drawings by reference numeral 10. As best seen in FIG. 1 demonstrating environment, bushing 10 is used with the spout assembly 12 of a fuel dispensing nozzle. Spout assembly 12 generally includes a spout 14 with an external spout spring 16. Spout 14 has an internal bore 18 with a vent tube assembly 20 operatively connected to a venturi 22 including a check valve 24 seated in a spout housing 26. The various components of spout assembly 12 function as generally known in the art.

Figure 2:
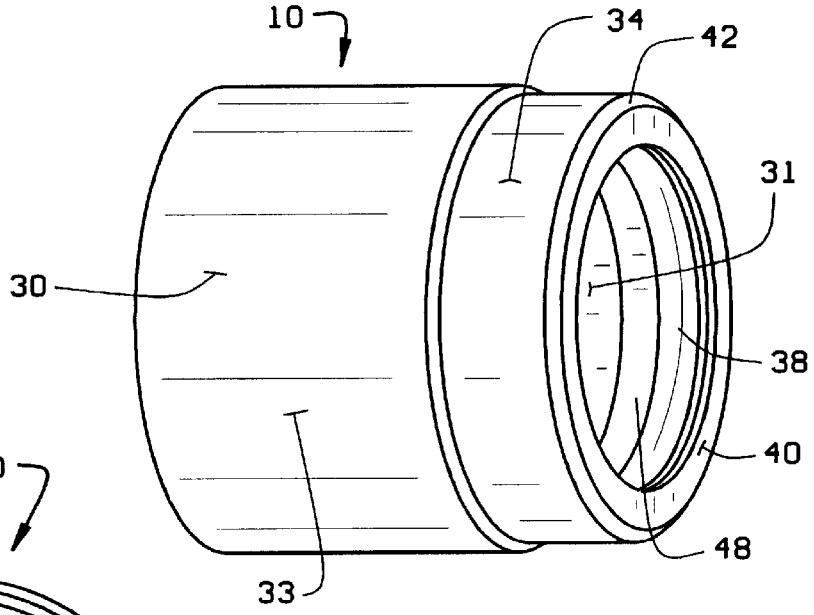
FIG. 2 is an enlarged perspective view of the spout bushing of the present invention.
Figure 3:
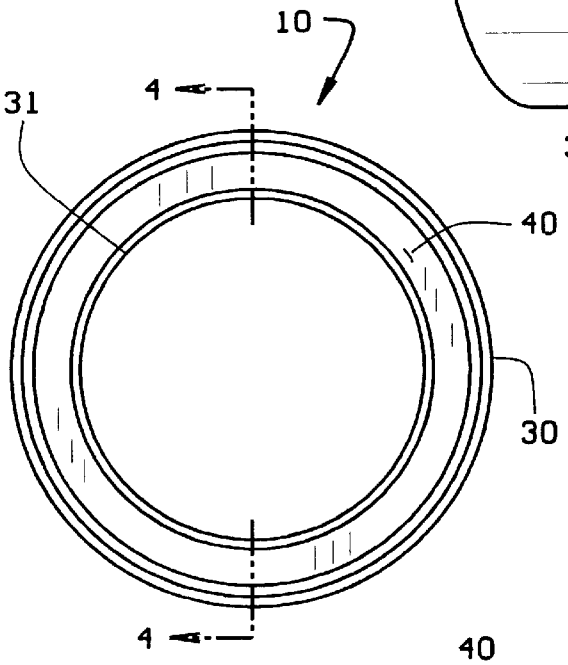
FIG. 3 is an end view of the spout bushing of the present invention.
Figure 4:
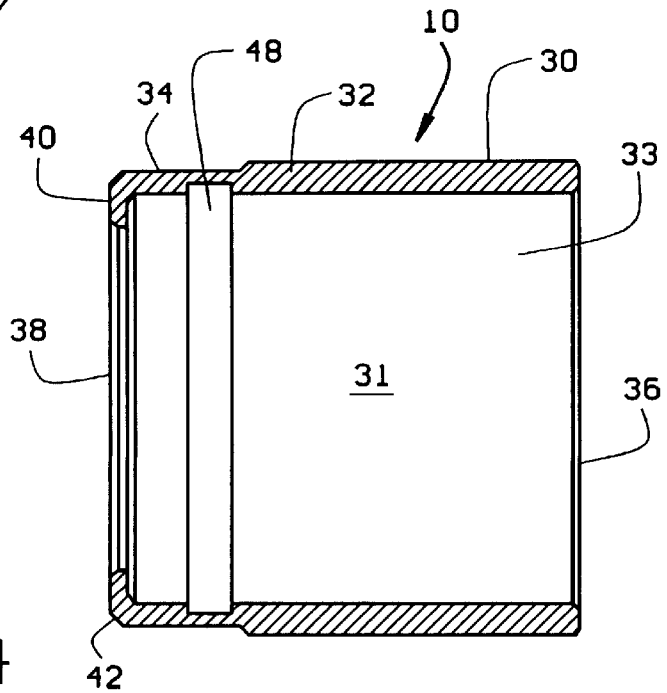
FIG. 4 is a cross section view thereof taken across line 4—4 of FIG. 3.

The novel spout bushing 10, configured to fit over the outlet end of the spout 14, is shown in greater detail in FIGS. 2–4. Spout bushing 10 comprises a generally tubular body 30 having an inner wall surface 31 which defines an internal bore 31. Body 30 includes a first section 33 and a concentric second section 34. As can be appreciated by the fact that second section 34 is concentric to first section 32, the outside diameter of the first section 33 is greater than the outside of the second section 34. The first section 33 includes a first open end 36 and the second section 34 includes a second open end 38 which enter into bore 31. First open end 36 is dimensioned to allow the bushing to be introduced over the outlet end of the spout. Second section 34 includes an end wall 40 connected to the section by a beveled junction 42. As can best be seen in FIGS. 2 and 3, end wall 40 slightly decreases the diameter of open end 38. As best seen in FIG. 1, wall 40 is approximately the same height as the wall thickness of the spout wall at its output end.

As can best be seen in FIG. 1, one embodiment of bushing 30 can include a vent opening 44 formed in body 30. When the bushing is installed over the end of the spout, the opening 44 is aligned with the open end 46 of tube 20 to allow the shut-off mechanism to properly function.

The inner wall surface 31 of body 30 includes and internal groove 48 formed in the therein generally at the junction of the first section 32 and the second section 34. As can be seen in FIG. 1, bushing 10 is installed by sliding over the outlet end of the spout. The bushing is retained over the end by tight friction fit created by the swage operation. The swage operation presses some spout material into groove 48 to secure the bushing in place. The outlet end of the spout abuts end wall 40 so that the end wall protects the outlet end of the spout from damage.

As can be seen, particularly in FIG. 1, bushing 10 is designed to protect the output end of the nozzle spout. Further, if bushing 10 because damaged or distorted in use, the bushing can be removed and replaced. Also, it should be apparent that the spout spring 16 abuts the bushing 10 which prevents the spout spring from sliding off or migrating down the length of the spout.

It will be apparent to those skilled in the art the various changes and modifications may be made in the bushing of the present invention without departing from the scope of the appended claims. Therefore, the foregoing description and accompanying drawings are intended to be illustrative only and should not be construed in a limiting sense.

I claim:

1. In a fuel dispensing nozzle having a generally tubular discharge spout for the dispensing of fuel, the improvement comprising a replaceable external protective bushing for installation over a discharge end of the tubular discharge spout disposed to increase the effective wall thickness of the discharge end of the tubular spout and thereby protect the discharge end of the spout from distortion that can interfere with fuel flow from the discharge end of the spout, said replaceable bushing formed as a generally tubular body defining an inner cavity and said tubular body including a first section having a first open end and a concentric second section having a second open end, the tubular body having an inner diameter defined by an inner wall surface generally constant from the first open end to the second open end, which is approximately the same as the outside diameter of the dispensing nozzle spout, the inner wall surface having a groove formed in an inner surface thereof, said bushing being formed from a malleable metal, and said groove formed in said tubular body of the replaceable bushing disposed for the reception of any spout material therein during a swaging operation that applies the replaceable bushing onto the proximate discharge outlet end of the fuel dispensing nozzle during assembly.

2. The bushing of claim 1 wherein said bushing is formed of aluminum.

3. The bushing of claim 1 and including a spout spring applied to the tubular spout, and said bushing being dimensioned to abut the spout spring and secure the spout spring in place on the exterior of the spout when assembled.

* * * * *